US008385572B2

(12) United States Patent
Dreβler et al.

(10) Patent No.: US 8,385,572 B2
(45) Date of Patent: Feb. 26, 2013

(54) METHOD FOR REDUCING NOISE USING TRAINABLE MODELS

(75) Inventors: Oliver Dreβler, Fürth (DE); Eghart Fischer, Schwabach (DE); Ulrich Kornagel, Erlangen (DE); Wolfgang Sörgel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1086 days.

(21) Appl. No.: 12/075,440

(22) Filed: Mar. 11, 2008

(65) Prior Publication Data

US 2008/0247577 A1 Oct. 9, 2008

Related U.S. Application Data

(60) Provisional application No. 60/906,424, filed on Mar. 12, 2007.

(51) Int. Cl.
*H04R 25/00* (2006.01)

(52) U.S. Cl. ..... 381/317; 381/94.1; 381/94.7; 381/318; 381/312; 381/60

(58) Field of Classification Search ..... None
See application file for complete search history.

(56) References Cited

U.S. PATENT DOCUMENTS

| | | | | |
|---|---|---|---|---|
| 4,901,353 | A * | 2/1990 | Widin | 381/312 |
| 5,604,812 | A * | 2/1997 | Meyer | 381/314 |
| 5,892,836 | A * | 4/1999 | Ishige et al. | 381/316 |
| 7,590,530 | B2 * | 9/2009 | Zhao et al. | 704/226 |
| 2005/0129262 | A1 * | 6/2005 | Dillon et al. | 381/312 |
| 2007/0055508 | A1 | 3/2007 | Zhao et al. | |

FOREIGN PATENT DOCUMENTS

| | | |
|---|---|---|
| DE | 10114101 A1 | 6/2002 |
| EP | 1760696 A2 | 3/2007 |

OTHER PUBLICATIONS

Yariv Ephraim and David Malah; "Speech Enhancement Using a Minimum Mean-Square Error Short-Time Spectral Amplitude Estimator" IEEE Transactions on Aoustics, Speech, and Signal Processings, vol. ASSP-32, Nr. 6, Dec. 1984; Others; 1984.

* cited by examiner

*Primary Examiner* — Yuwen Pan
*Assistant Examiner* — Taunya McCarty

(57) ABSTRACT

The object is to improve the effect of a noise reduction algorithm for hearing apparatuses and in particular hearing aids. This is achieved by a method wherein the input signal is modeled by a wanted signal model and a noise signal model. In addition, a signal statistic of the input signal is recorded in a data logging unit. The wanted signal model and/or the noise signal model can now be changed as a function of said signal statistic. Finally the noise component of the input signal is reduced using the noise signal model and/or the wanted signal model. This means that the models used can be continuously adapted to the hearing apparatus user's current situation.

15 Claims, 2 Drawing Sheets

METHOD FOR REDUCING NOISE USING TRAINABLE MODELS

CROSS REFERENCE TO RELATED APPLICATIONS

The present application claims the benefit of the provisional patent application filed on Mar. 12, 2007, and assigned application No. 60/906,424, and is incorporated by reference herein in its entirety.

FIELD OF THE INVENTION

The present invention relates to a method for reducing noise in hearing apparatuses by picking up an input signal, modeling the signal using a wanted signal model and a noise signal model, and reducing the noise component of the input signal using the unwanted sound estimated by the noise signal model. The term "hearing apparatus" is understood here as meaning in particular any device that can be worn in or on the ear, such as a hearing aid, a headset, headphones or the like.

BACKGROUND OF THE INVENTION

Hearing aids are portable hearing apparatuses for use by the hard of hearing. In order to meet the numerous individual requirements, different hearing aids types are available, such as behind-the-ear (BTE) hearing aids, in-the-ear (ITE) hearing aids, and concha hearing aids. The hearing devices listed by way of example are worn in the outer ear or in the auditory canal. However, bone conduction hearing aids, implantable or vibrotactile hearing aids are also commercially available. In these cases, the damaged hearing is stimulated either mechanically or electrically.

The basic components of a hearing aid are essentially an input transducer, an amplifier and an output transducer. The input transducer is generally a sound receiver, e.g. a microphone, and/or an electromagnetic receiver such as an induction coil. The output transducer is mainly implemented as an electroacoustic transducer, e.g. a miniature loudspeaker, or as an electromechanical transducer such as a bone conduction earpiece. The amplifier is usually incorporated in a signal processing unit. This basic design is shown in FIG. 1 using the example of a behind-the-ear hearing aid. Installed in a hearing aid housing 1 for wearing behind-the-ear are one or more microphones 2 for picking up sound from the environment. A signal processing unit 3 which is likewise incorporated in the hearing aid housing 1 processes the microphone signals and amplifies them. The output signal of the signal processing unit 3 is transmitted to a loudspeaker or earpiece 4 which outputs an audible signal. The sound is in some cases transmitted to the wearer's eardrum via a sound tube which is fixed in the auditory canal using an earmold. The hearing aid and in particular the signal processing unit 3 are powered by a battery 5 likewise incorporated in the hearing aid housing 1.

Monaural noise reduction methods are a fixed component of hearing aids. Frequency-domain methods using spectral weighting, e.g. Wiener filter or spectral subtraction, are used for this purpose.

With these noise reduction methods, the noise component must be estimated from the received noisy signal. For this estimation, the minimum statistics method, for example, can be used. In addition to noise estimation, estimation of the amplitude spectrum of the wanted signal is also necessary for Ephraim-Malah spectral weighting.

Both the wanted signal estimation algorithms and the noise signal estimation algorithms are based on particular, mainly simplifying assumptions in respect of the signal statistic. Thus, for example, for determining the Ephraim-Malah weighting rules, the wanted signal amplitude spectra are assumed to be Gauss distributed (cf. EPHRAIM, Y.; MALAH, D.: Speech Enhancement Using a Minimum Mean-Square Error Short-Time Spectral Amplitude Estimator. In: IEEE Transactions on Acoustics, Speech and Signal Processing, December 1984, Vol. ASSP-32 No. 6, pages 1109-1121).

However, the actual statistical characteristics of the wanted and noise signal are usually much more complex and are therefore only taken into consideration to a limited extent in the methods mentioned. In addition, the parameters for optimum noise reduction effect with minimal wanted signal distortion are normally in fixed settings during operation.

In the case of non-static noise, the effect of the noise reduction methods mentioned is severely limited. Because the signal statistic has to be acquired over a sufficiently long time, the estimation of a high time-domain dynamic range of the noise can follow only relatively slowly. This reduces the noise reduction effect in such situations.

With the hitherto known methods, no a priori available information is utilized for acquiring the signal statistic. Even if the signal statistic is taken into account, in all the methods only a finite number of statistically different signal models are used during operation. These signal models are all in a fixed form. In addition, the modeling, particularly for the wanted signal, is very complex and also mainly defined for one type of signal such as voice. The noise modeling is also mainly limited to the spectral envelope only. This means that in the case generally arising in practice, a plurality of spatially separated noise signals can be mapped only with great difficulty. Both the spatial and the spectral characteristics may also change over time.

Publication DE 101 14 101 A1 discloses a method for processing an input signal in a signal processing unit of a hearing aid. In the hearing aid, adjustment parameters of a signal processing unit which relate to noise reduction are set as a function of the result of signal analysis of the input signal. If noise signals are detected, they are assigned to different noise signal categories. Different noise reduction algorithms are activated and deactivated depending on the noise signal category determined.

SUMMARY OF THE INVENTION

The object of the present invention is therefore to improve the effect of noise reduction methods.

To achieve this object there is proposed according to the invention a method for reducing noise in hearing apparatuses by picking up an input signal, modeling the input signal with a wanted signal model and a noise signal model and reducing the noise component of the input signal using the noise signal model and/or the wanted signal model, and also acquiring a signal statistic of the input signal and changing the wanted signal model and/or the noise signal model as a function of the signal statistic. In this context the term "changing" is to be understood not as "replacing" a model, but as modifying and adapting the content of a model.

The invention is advantageously based on the recognition that a priori available information for acquiring the signal statistic can be used for obtaining the parameters of suitable models of the wanted signal and of the noise signal, the fixed model parameters having to be set using statistically relevant training data in such a way that maximally comprehensive mapping of the signal statistic is achieved. The inventive noise reduction is not therefore performed as in known methods using fixed assumptions with regard to signal estimation or using signal model parameters that have been pre-trained in a fixed manner. On the contrary, by acquiring the individual wanted and noise signal statistic, the noise reduction can be optimally matched to the current situation of the hearing aid wearer or hearing apparatus user.

According to a specific embodiment, one or both of the wanted signal model and noise signal model of the inventive noise reduction algorithm can be autoregressive models with trained codebooks, models with overcomplete codebooks, models based on transformations or wavelet representations, models with decompositions into tonal, transient and noise-like components and signal statistical modelings. This means that the models to be trained can be initiated with "pre-knowledge".

According to another embodiment it can be provided that, during operation of the hearing apparatus, data logging of the input signal and/or of its signal statistic relating to parameters of the model to be changed is carried out and the model to be changed is trained using the logged data. Using the logged data, training can thus take place in real time. Preferably, data logging and training take place automatically in a continuous manner. A current newly trained signal model is therefore always available.

A noise reduction quality metric can be used for selecting a wanted signal model and a noise signal model.

In addition to the wanted signal model and the noise signal model, at least one other model selectable by the hearing apparatus user can be trained and used for noise reduction instead of the wanted signal model or noise signal model. The user can therefore himself be involved in the process of deciding on the model to be used and subjectively influence noise reduction.

According to another embodiment of the inventive method, the model to be changed can also be changed on the basis of a noise or wanted signal estimation carried out in real time, thereby also enabling model parameters to be obtained by estimations.

Another preferred embodiment of the present invention consists in that at least one other model is used to estimate the unwanted or wanted sound in addition to the noise signal model and the wanted signal model. Thus, for example, by using a plurality of parallel noise signal models, even complex noise originating from a plurality of different sources can be effectively suppressed.

BRIEF DESCRIPTION OF THE DRAWINGS

The present invention will now be explained in greater detail with reference to the accompanying drawings in which.

DETAILED DESCRIPTION OF THE INVENTION

The exemplary embodiments described in greater detail below represent preferred embodiments of the present invention.

The noise suppression systems presented here generally relate to systems in which at least one noisy input signal is simulated by modeling, at least one model being used for a wanted signal component and a noise signal component in each case, the parameters of which are estimated as a function of the input signal such that the model optimally describes the input signal according to a particular criterion. Possible models typically include autoregressive models with trained codebooks as well as models with overcomplete codebooks, models based on transformations such as the Fourier transformation, the discrete cosine transformation or based on wavelet representations, models with decompositions into tonal, transient and noise-like components, signal statistical modeling or other suitable models. Using the thus obtained model-like descriptions for the wanted and noise signal, noise suppression can be carried out by means of various known techniques.

For the inventive noise suppression, one or more signal models are suitably adapted individually to the input signal statistic actually present. For this purpose there exist fundamentally different adaptation possibilities, as described in greater detail below in connection with FIGS. 2 to 4.

Figure 1:
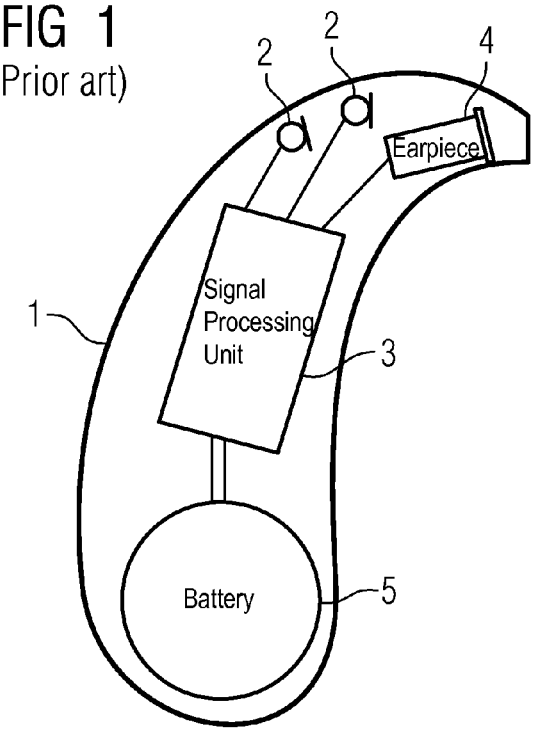
FIG 1 (Prior art)
FIG. 1 shows the basic design of a prior art hearing aid.
Figure 2:
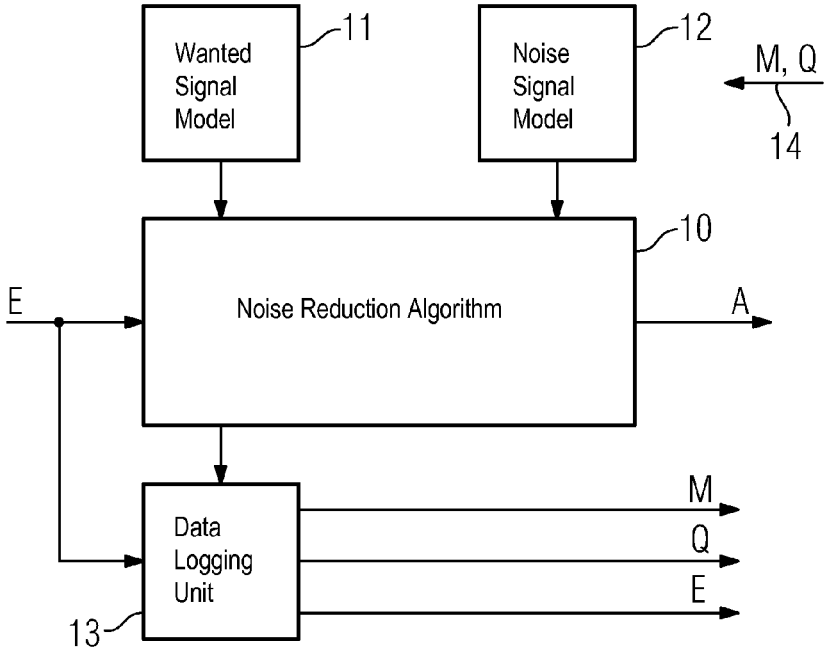
FIG. 2 shows a block diagram for the adaptation of the signal models by means of data logging according to the present invention.

The system as shown in FIG. 2 has a model-based noise reduction algorithm 10 as a central component. An input signal E is fed to it and it produces a corresponding output signal A. The noise reduction algorithm 10 is based on the one hand on a wanted signal model 11 and on the other on a noise signal model 12. It additionally supplies a data logging unit 13 in which the input signal E is also logged. Logged model parameters M, logged quality metrics Q as well as the logged input signal E can therefore be read out from data logging unit 13.

During operation of the hearing apparatus or more specifically hearing aid, the input signal and/or its signal statistic which is mapped by the corresponding model parameters are recorded by means of data logging in the data logging unit 13. The logging can take place continuously or else as a function of the quality of the noise reduction currently achieved. A corresponding quality metric Q is constantly available and can initiate logging e.g. if a threshold is undershot. However, logging can also, for example, be initiated manually by the user.

Using the logged data, the training for improved model parameters M of the wanted signal and/or noise signal can then take place at the time of evaluation at the hearing aid acoustician's. This subsequent training is indicated by the arrow 14 in FIG. 2. Depending on the frequency of the logging periods, in the event of a simultaneously bad quality metric, the signal models already being used can be exchanged for the newly trained models.

A further improvement can be achieved by using not only an implementation for the wanted and/or noise signal model, but a plurality of models for different signal statistics. Such a system is shown by way of example in FIG. 3. Its core element is again the noise reduction algorithm 20 which is fed with an input signal E and which produces a corresponding output signal A. It is based on a plurality of wanted signal models 211, 212 and a plurality of noise signal models 221, 222 and 223. A specially provided model evaluation unit 24 selects for the noise reduction algorithm 20 a model from the wanted signal models 211, 212 and the noise signal models 221, 222 and 223. Model selection takes place on the basis of situation detection carried out by a situation detection unit 25 on the basis of the input signal E. With the aid of the situation detection algorithm, the signal model best suited to the current situation is selected. Situation detection is suitable for selecting, for example, the appropriate wanted signal models for voice or music.

There is again provided a data logging unit 23 which, in addition to the input signal E, also logs signals from the noise reduction algorithm 20. It also optionally records data concerning the models selected, as symbolized by the dashed arrows in FIG. 3. The data logging unit 23 then provides, as in the example in FIG. 2, logged model parameters M, a logged quality metric Q and the logged input signal E. The model parameters M are used to modify the wanted signal models 211, 212 and/or the noise signal models 221, 222 and 223.

The data provided by the data logging unit 23 can be used e.g. by a hearing aid acoustician to change the per se static models 211, 212, 221, 222 and 223 during operation. This means the hearing aid acoustician can change the models e.g. using the logged model parameters M and the logged quality metric Q, as indicated by the arrow 26 in FIG. 3. During operation the models are again static.

The models newly trained using data logging can then, depending on the available memory, be added to the existing data models or existing models can be exchanged. Exchanging a model is indicated if the associated quality metrics Q are poor or rarely used.

Figure 3:
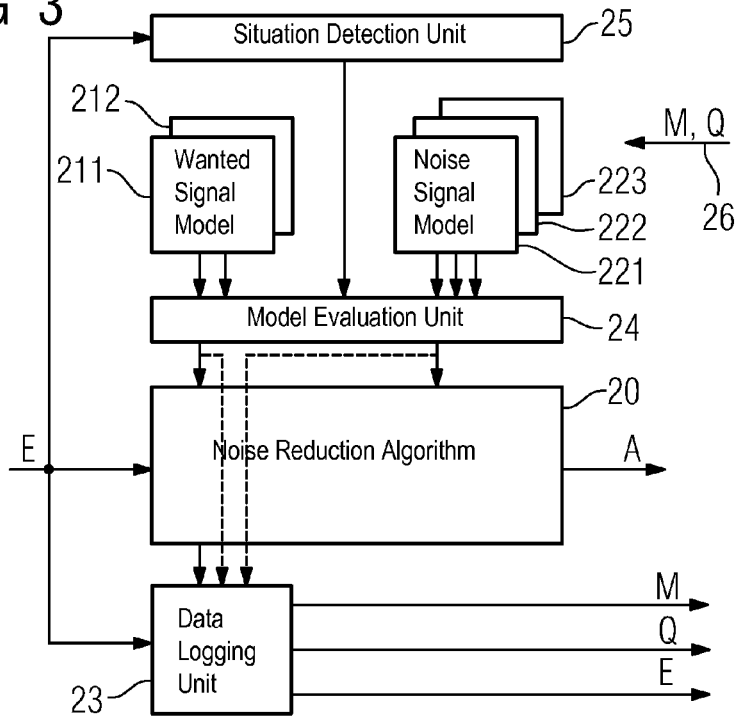
FIG. 3 shows a block diagram for the adaptation of a plurality of signal models by means of data logging.

In the exemplary embodiments in FIG. 2 and FIG. 3 the wanted signal and noise signal models are static during operation. In the example in FIG. 4 dynamic models are also used. The core element of this system is once again the model-based noise reduction algorithm 30 to which the input signal E is fed, and from which a corresponding output signal A with reduced interfering noise can be obtained. Here the noise algorithm 30 is based not only on a static wanted signal model 31 and a static noise signal model 32, but also on an updatable i.e. dynamic wanted signal model 37 and a likewise updatable, dynamic noise signal model 38. The two dynamic models are automatically trainable by a training algorithm 39. The latter derives training information from the input signal E and obtains additional situation data from the situation detector 35 which is likewise fed by the input signal E. On the basis of predefined criteria, possibly feedback from the noise reduction algorithm 30, the model evaluation unit 34 makes a selection of the models to be used.

Figure 4:
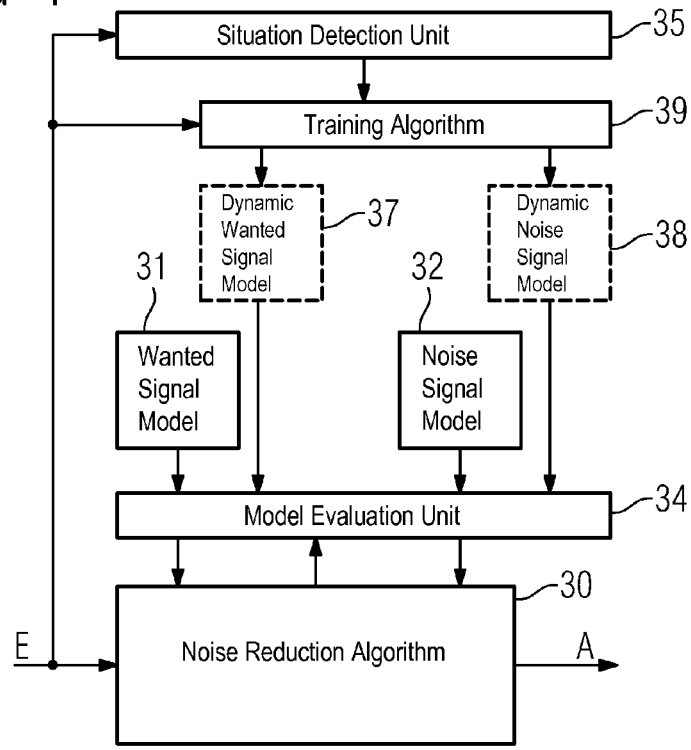
FIG. 4 shows a block diagram with automatic adaptation of the signal models.

The system shown in FIG. 4 operates as follows: it is basically possible to adapt the signal models 37, 38 automatically to the signal statistic currently present. For this purpose, depending on the situation detected in the situation detection unit 35, at least one new wanted or noise signal model adapted to the individual signal statistic is trained. This ongoing training generally provides continuously modified signal models. If the quality metric from model-based noise reduction 30 deteriorates and a sufficiently stable signal statistic is available in the new adapted signal model, the currently used signal models can be replaced by the newly trained signal models or supplemented by said new signal models.

However, the decision to exchange a signal model for a newly trained signal model can also be left to the user. To this end, as described above, automatic pre-selection of the new models is performed by means of continuous training, and the user can then switch between two combinations of effective signal models e.g. by interaction via a remote control. The better combination for the user in the current situation is then selected.

The parameters of the above described signal models are obtained by means of a training algorithm. According to another exemplary embodiment, the signal models can also be augmented by appropriate model parameters from an estimation carried out in real time. This means that the model parameters can be adapted by estimation instead of or in addition to training. To estimate the noise signal, it is possible to use, for example, the minimum statistics method or the residual noise at the output of a directional microphone signal processing unit. The parameters from the continuous training are provided with a hypothesis for the corresponding signal model by the estimated parameters. It is additionally possible, depending on the current situation, also to combine a plurality of signal models for describing a complex signal statistic instead of selecting an individual signal model, thereby enabling e.g. a plurality of noise sources with different signal statistics to be described.

The invention claimed is:

1. A method for reducing a noise in a hearing apparatus, comprising:

picking up an input signal;

modeling the input signal with a noise reduction algorithm based on data models having model parameters, the data models comprising a wanted signal model and a noise signal model, and providing by the noise reduction algorithm a signal statistic based on the modeling;

computing a quality metric Q representing a current quality of noise reduction achieved by the noise reduction algorithm from the input signal and the signal statistic;

based on a threshold of the quality metric:

(i) logging in a data logging unit data comprising the input signal, and the model parameters and the quality metric from the noise reduction algorithm;

(ii) training for improved data models using the logged data;

(iii) changing the data models comprising one or both of the wanted signal model and the noise signal model with the improved data models as a function of the signal statistic based on the logged quality metric Q; and producing an output signal having reduced noise based on the noise reduction algorithm based on the data models.

2. The method as claimed in claim 1, wherein the wanted signal model or the noise signal model is selected from the group consisting of: an autoregressive model with a trained codebook, a model with an overcomplete codebook, a model based on a transformation, a model based on a wavelet representation, a model with a decomposition into a tonal, transient and noise-like component, a model with signal statistical modeling, and any combinations thereof.

3. The method as claimed in claim 1, wherein the signal statistic is provided by mapping the input signal to a model parameter of the noise reduction algorithm based on the data models.

4. The method as claimed in claim 1, wherein changing the data models comprises adding the improved data models to a memory or, when a threshold of a quality metric is undershot by the data models currently being used, exchanging in memory the data models currently being used with the improved data models.

5. The method as claimed in claim 1, further comprising selecting from a plurality of data models the wanted signal model and the noise signal model via a model evaluation unit, wherein the selection is based on a situation detected from the input signal to provide data models based on the situation detected.

6. The method as claimed in claim 1, wherein the data models are changed based on real-time estimation of a noise signal or a wanted signal.

7. The method as claimed in claim 1, wherein the training and changing of the data models are carried out separate from operation of the hearing apparatus such that the data models are static during operation of the hearing apparatus.

8. The method as claimed in claim 1, wherein the training and changing of the data models is carried out during operation of the hearing apparatus such that the data models are dynamic during operation of the hearing apparatus.

9. A method for reducing a noise in a hearing apparatus, comprising:

picking up an input signal E;

modeling the input signal with a noise reduction algorithm based on data models in a memory having model parameters, the data models comprising a wanted signal model and a noise signal model, and providing by the noise reduction algorithm a signal statistic based on the modeling;

computing a quality metric Q representing a current quality of noise reduction achieved by the noise reduction algorithm from the input signal and the signal statistic;

based on a threshold of the quality metric:

(i) logging in a data logging unit data comprising the input signal E, and the model parameters M and the quality metric Q from the noise reduction algorithm;

(ii) providing to a training algorithm for training for improved data models the logged quality metric Q and the logged model parameters M from the data logging unit;

(iii) changing in the memory the data models comprising one or both of the wanted signal model and the noise signal model with the improved data models as a function of the signal statistic based on the logged quality metric Q; and producing an output signal having reduced noise based on the noise reduction algorithm based on the data models.

10. The method as claimed in claim 9, further comprising selecting from a plurality of data models the wanted signal model and the noise signal model via a model evaluation unit, wherein the selection is based on a situation detected from the input signal to provide data models based on the situation detected.

11. The method as claimed in claim 9, wherein the training and changing of the data models is carried out separate from operation of the hearing apparatus such that the data models are static during operation of the hearing apparatus.

12. The method as claimed in claim 9, wherein the training and changing of the data models is carried out during operation of the hearing apparatus such that the data models are dynamic during operation of the hearing apparatus.

13. A hearing apparatus, comprising:

an input device that receives an input signal;

a memory for storing data models; and a noise reduction algorithm for modeling the input signal with the data models having model parameters, the data models comprising a wanted signal model and a noise signal model, providing a signal statistic based on the modeling, computing a quality metric Q representing a current quality of noise reduction achieved, and producing an output signal having reduced noise based on the data models; and a data logging unit for logging data for use in training improved data models based on a threshold of the quality metric Q, the data comprising the input signal, the model parameters, and the quality metric, wherein the logged quality metric Q is used for changing the data models comprising one or both of the wanted signal model and the noise signal model as a function of the signal statistic with the improved data models.

14. The hearing apparatus as claimed in claim 13, further comprising an evaluation unit for selecting from a plurality of data models the wanted signal model and the noise signal model, wherein the selection is based on a situation detected from the input signal to provide data models based on the situation detected.

15. The hearing apparatus as claimed in claim 13, further comprising a training algorithm for obtaining the data from the data logging unit for training the improved data models, such that when a threshold of a quality metric is undershot for the data models currently being used, the data models currently being used are exchanged for improved data models.

* * * * *